US005690278A

United States Patent [19]

Grubb

[11] Patent Number: 5,690,278

[45] Date of Patent: Nov. 25, 1997

[54] TRACK SYSTEMS FOR MODEL RAILROADS

[75] Inventor: Lawrence B. Grubb, Baltimore, Md.

[73] Assignee: Life-Like Products, Inc., Baltimore, Md.

[21] Appl. No.: 586,590

[22] Filed: Jan. 16, 1996

[51] Int. Cl.[6] ..... A63H 19/30

[52] U.S. Cl. ..... 238/10 E; 238/10 F

[58] Field of Search ..... 238/10 R, 10 A, 238/10 B, 10 C, 10 E, 10 F

[56] References Cited

U.S. PATENT DOCUMENTS

| | | | |
|---|---|---|---|
| 4,082,220 | 4/1978 | Cheng et al. | 238/10 F |
| 4,091,995 | 5/1978 | Barlow et al. | 238/10 F |
| 4,150,789 | 4/1979 | Tong | 238/10 E |
| 4,195,776 | 4/1980 | Lehmann | 238/10 C |
| 4,997,187 | 3/1991 | Smoller et al. | 238/10 E |
| 5,503,330 | 4/1996 | Riley | 238/10 E |

FOREIGN PATENT DOCUMENTS

| | | | |
|---|---|---|---|
| 522646 | 1/1993 | European Pat. Off. | 238/10 F |

*Primary Examiner*—S. Joseph Morano

*Attorney, Agent, or Firm*—Mark P. Stone

[57] ABSTRACT

The present invention is directed to track locking systems for model railroads of the type in which separate sections of track are removably connected to form a desired closed pattern over which a model train will travel. The track sections include electrically conductive rails for supporting and guiding the model train thereon, and for providing electrical energy from a source for driving the train. Individual track bed sections connected to each other are joined at two laterally offset positions to enhance the stability of the sections removably locked together. The locking elements on the respective track sections joined together are oriented at substantially right angles to the direction of the rails to further enhance the stability and integrity of the joined track sections. A secure connection between locked track sections assures a positive engagement between electrical connectors to provide a completed electrical circuit when the track sections are joined in the desired closed pattern.

19 Claims, 5 Drawing Sheets

TRACK SYSTEMS FOR MODEL RAILROADS

BACKGROUND OF THE INVENTION

Hobby enthusiasts for many years have enjoyed the operation of model railroad trains of the type in which separate track sections are removably joined together to form a closed path designed by the hobbyist over which a model train will travel. Each track section includes electrical conductor means so as to form a closed electrical circuit when the track sections are joined together in a closed configuration or pattern. Means are provided for supplying electrical energy to the rails of the assembled track sections to energize the model train travelling thereon. It is therefore of significant importance that the individual joined track sections be securely locked together to establish firm engagement and contact between the respective electrical connectors to assure that electrical current will be continuously delivered to the train during operation of the model railroad set.

In the past, model railroad sets have employed so-called "track connectors" to assure electrical continuity between different track sections joined together. The "track connectors" are effectively metal pieces extending from the ends of the rails of the individual track sections for assuring electrical contact between the rails of the adjacent track sections removably joined together. However, known disadvantages are associated with systems employing the so-called "track connectors". Among other things, the track connectors are likely to break off from the track sections to which they are joined because the track connectors extend beyond the ends of the track sections. Additionally, the inclusion of "track connectors" increases the complexity of the manufacturing process of the track sections, and thus tends to increase the overall cost of the model railroad track sets to the consumer. A further disadvantage of the conventional "track connector" extension elements is that such elements render it more difficult to assemble adjacent track sections together since the assembly requires precise alignment between a track connector extending from one track section and the corresponding rail of the adjacent track section to be removably joined together.

It is a primary object of the present invention to provide a track system in which the individual track sections are designed to be removably interlocked together to provide a secure engagement between the electrical conductors of the respective sections without employing the conventional "track connector" extending from the ends of the rails of the respective sections. The present invention is particularly useful in connection with track systems for model railroad sets. The locking means in accordance with the preferred embodiments of the present invention results in a track connection system for model railroad sets which facilitates the manufacture and assembly of a model railroad track sections, and provides a secure electrical engagement between electrical conductors of the joined track sections to provide continuous delivery of electrical energy to a model train during operation of the set.

Other objects, features and advantages of the invention will become apparent from the following description.

SUMMARY OF THE INVENTION

The present invention provides an improvement to track systems of the type in which individual track sections are joined together to define a closed pattern over which a toy will travel. The invention is particularly adapted to electrically actuated model railroad sets. The individual track sections each include two parallel rails formed from an electrically conductive material for guiding a model train travelling over the assembled tracks and for providing electrical energy to the train from an electrical power source coupled to the rails. In accordance with the present invention, the individual track sections to be removably locked together are designed so that each track section is joined to an adjacent track section at two separate locking positions which are laterally offset from each other. In this manner, the two locking positions are not oriented along a single linear axis which is substantially perpendicular to the longitudinal direction of the track sections, and thus the adjacent track sections are not removably locked together along a linear pivot axis. As a result, the continuously abutting end sections of the adjacent track sections joined together are firmly and securely engaged together to assure a firm and continuous engagement between the electrically conductive rails carried by the respective adjacent track sections.

The track sections in accordance with the present invention are also designed such that the means for removably locking the ends of adjacent track sections together are oriented in a direction which is not linear with (and preferably substantially perpendicular to) the longitudinal direction of extension of the track/rail sections. In this manner, a stronger joint is provided between adjacent, removably interlocked track sections, enhancing the stability of the locking engagement and reducing the possibility of disengagement of track sections during operation of the model train. Disengagement of track sections can result in derailment of the train, and/or disruption of electrical energy supplied to the train. The substantial perpendicular orientation of the locking means relative to the direction of longitudinal extension of the joined track sections assures that movement of the train along the tracks (and other forces which might be inadvertantly applied to the assembled track sections in the direction of travel of the model train therealong), will not act in the direction of orientation of the locking means, thereby decreasing the possibility of disengagement or separation of adjacent track sections.

A model railroad track system in accordance with the present invention advantageously results in enhanced locking stability of adjacent track sections, and therefore more positive and secure engagement of electrical conductors carried by the respective joined track sections. The track system of the present invention further eliminates the need to employ conventional "track connector" rail extension elements, and thus eliminates the aforementioned disadvantages thereof.

DESCRIPTION OF THE BEST MODES FOR CARRYING OUT THE INVENTION

The improved track system in accordance with the present invention will be discussed in greater detail with reference to FIGS. 1-4 of the drawings. Since the invention is particularly useful in connection with electrically energized model railroad sets, the preferred embodiments will be discussed with reference to this specific application of the invention.

Figure 1:
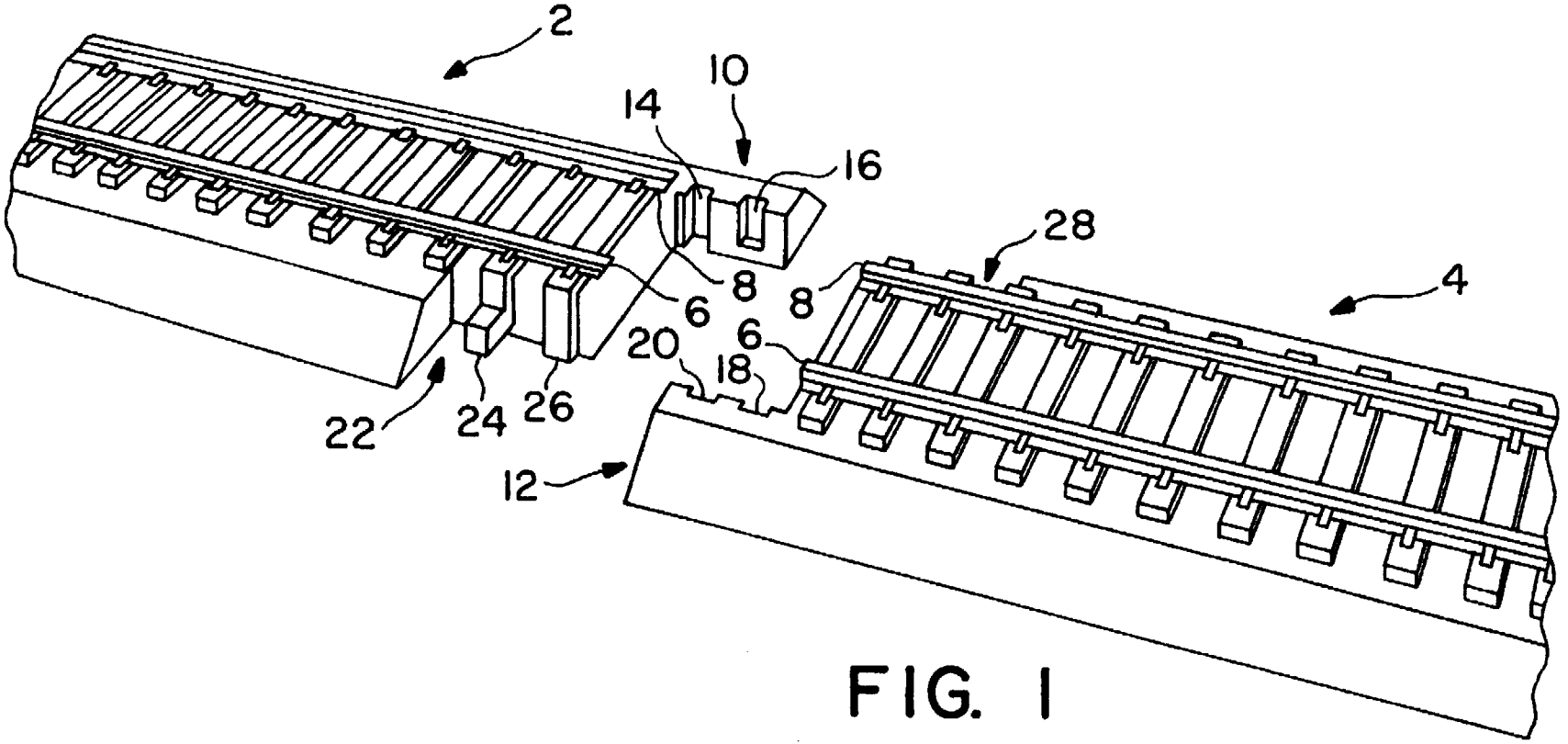
FIG. 1 of the drawing is a perspective view of two separate track sections to be joined together in accordance with the present invention, prior to assembly of the sections.

Referring now to FIG. 1, a first combined trackbed/rail section is designated by reference numeral 2, while a second similar section is designated by reference numeral 4. Each of the sections 2 and 4 include two parallel rail sections 6 and 8 adapted to receive and guide the wheels of a model train, and formed from an electrically conductive material to transmit electrical energy to the train from an independent power supply electrically coupled to the rails.

Still referring to FIG. 1, section 2 includes an extended portion 10 on one side of an end thereof, while section 4 includes an identical extended portion 12 on the opposite side of an adjacent end thereof. Extended section 10 defines two differently configured recessed portions 14 and 16, while extended portion 12 defines correspondingly configured recessed portions 18 and 20.

Section 2 illustrated by FIG. 1 further includes a retracted portion 22 defined on the side of the track section opposite to the extended portion 10. The retracted portion 22 defines two differently configured, outwardly extending projections 24 and 26. Section 4 also includes an identically configured retracted section 28, including two projections (not shown) configured to correspond to projections 24 and 26, oriented on the side of section 4 opposite to the extended portion 12. Accordingly, each section 2 and 4 defines identical extended sections 10 and 12 including identically configured and positioned recessed portions defined on opposite sides of adjacent ends of the respective sections 2 and 4. Similarly, each section 2 and 4 defines identical retracted portions 22 and 28 defining identically configured and oriented outwardly extending projections, defined on opposite sides of adjacent ends of the respective sections 2 and 4. Preferably, the trackbed sections 2 and 4 supporting the parallel rails 6 and 8, and the respective projections extending from the retracted portions of the sections 2 and 4, are formed from a durable but resilient material, as for example a hard plastic.

Figure 1A:
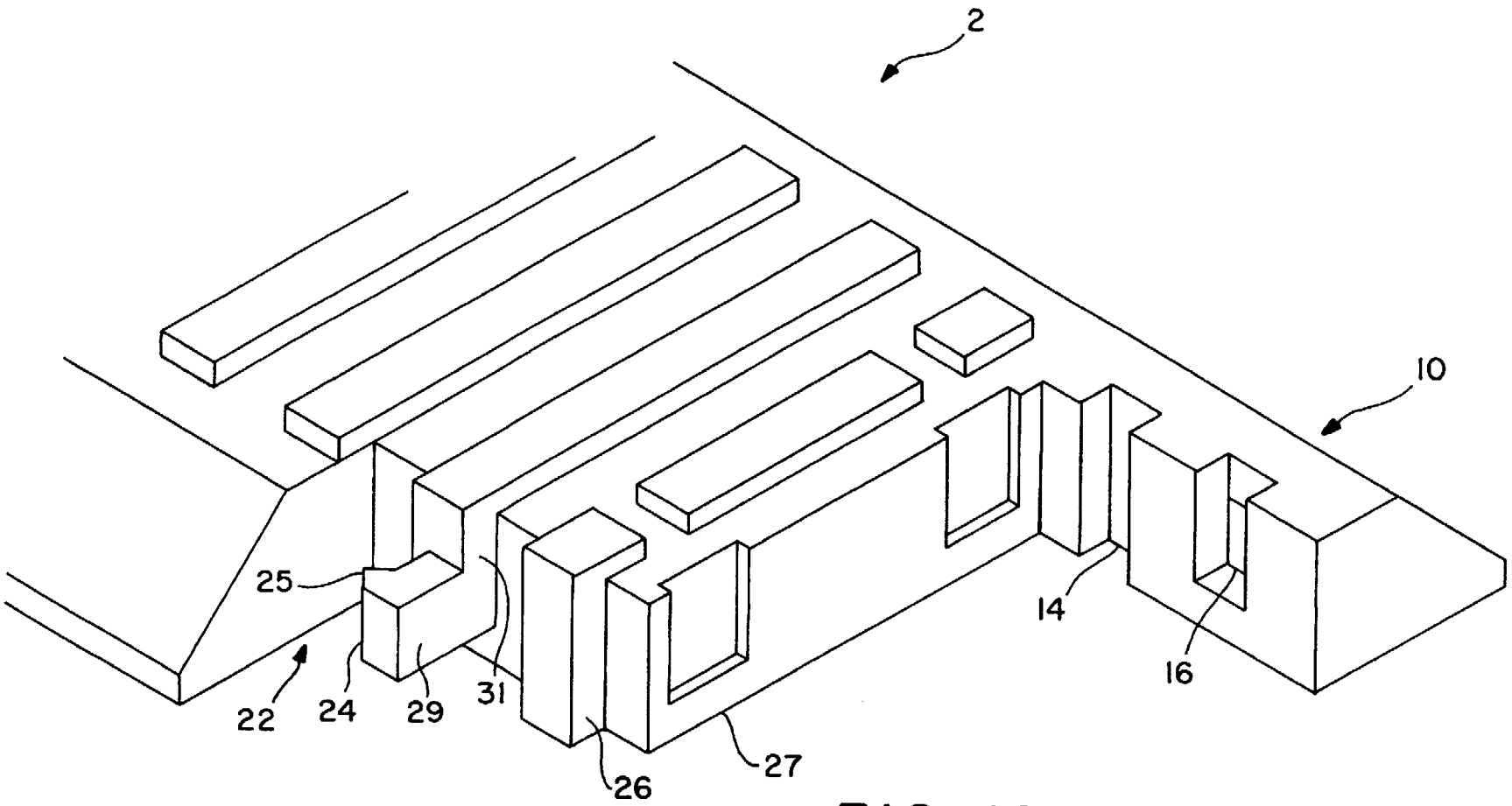
FIG. 1A of the drawing illustrates a perspective view of the end portion of one of the track sections, illustrated by FIG. 1, with the track and electrical connectors removed therefrom.

FIG. 1A illustrates the end portion of section 2 in greater detail than illustrated by FIG. 1. In particular, FIG. 1A shows that recess 16 on extended portion 10 is elevated above the lower or bottom surface 27 of the trackbed section 2, and outwardly extending projection 24 on the retracted section 22 is elevated at a height corresponding to the elevation of the recess 16. The projection 24 defines a tab section 25 extending therefrom.

Still referring to FIG. 1A, the recess 14 defined in extended portion 10 of the trackbed section 2 extends upwardly from the lower surface 27 of the trackbed section 2, and projection 26 similarly extends upwardly from the bottom surface 27 of the trackbed section 2.

FIG. 1A further illustrates that projection 24 is generally L-shaped and includes a horizontally oriented portion 29 and a vertically oriented portion 31. Recess 16 defined in extended portion 10 is configured and oriented to complement projection 24 extending from retracted portion 22, and recess 14 is defined and oriented on extended portion 10 to complement projection 26 extending from retracted portion 22. As a result of the complementary orientation and configuration of recess 16 and projection 24, and recess 14 and projection 26, and as a result of the resilient material from which the trackbed sections 2 and 4 are formed, the adjacent sections 2 and 4 can be removably locked and mated together by friction fit engagement of the respective projections and recesses defined on opposite sides of one end of section 2 with the corresponding projections and recesses defined on opposite sides of an adjacent end of section 4.

Referring back to FIG. 1, when sections 2 and 4 of trackbed are to be removably locked together, the adjacent ends of the sections are moved proximate to each other such that the extended portion 12 of section 4 is in linear alignment with the retracted portion 22 of section 2. Simultaneously, the oppositely oriented extended portion 10 of section 2 is in linear alignment with the retracted portion 28 of section 4. The track sections are then moved relative to each other in a lateral direction (transverse to the orientation of the rails 6 and 8) so that the respective projections on the retracted portions of sections 2 and 4 are received in the corresponding and complementary configured recesses defined on the respective extended portions of sections 2 and 4. Accordingly, the two projections are removably received in friction fitting locking engagement in two complementary configured and oriented recesses on each side of the joined adjacent ends of Sections 2 and 4. Relative movement of the trackbed sections 2 and 4 in the opposite direction are required to disengage the locked adjacent sections.

As a result of the orientation of the respective projections and recesses on the extended and retracted portions of adjacent ends of track sections, the positions of locking engagement of joined track sections are laterally offset at different sides of the joined sections. Thus, the locking engagement position(s) on one side of two joined sections, and the locking position(s) on the opposite side of the two joined track sections, are not along the same line drawn perpendicular to the longitudinal direction of the joined sections.

Although the preferred embodiment of the invention provides the locking projections on the retracted portion of a trackbed section and defines the recesses on the extended portion of a trackbed section, it is possible to reverse the respective positions of the projections and recesses. Moreover, it is possible to define both recesses and projections on both the extended and retracted portions of the track bed sections, and it is further possible to provide different numbers of projections and recesses, and different configurations and different orientations of projections and recesses than shown in the drawing. Other suitable locking means also can be employed.

Figure 2:
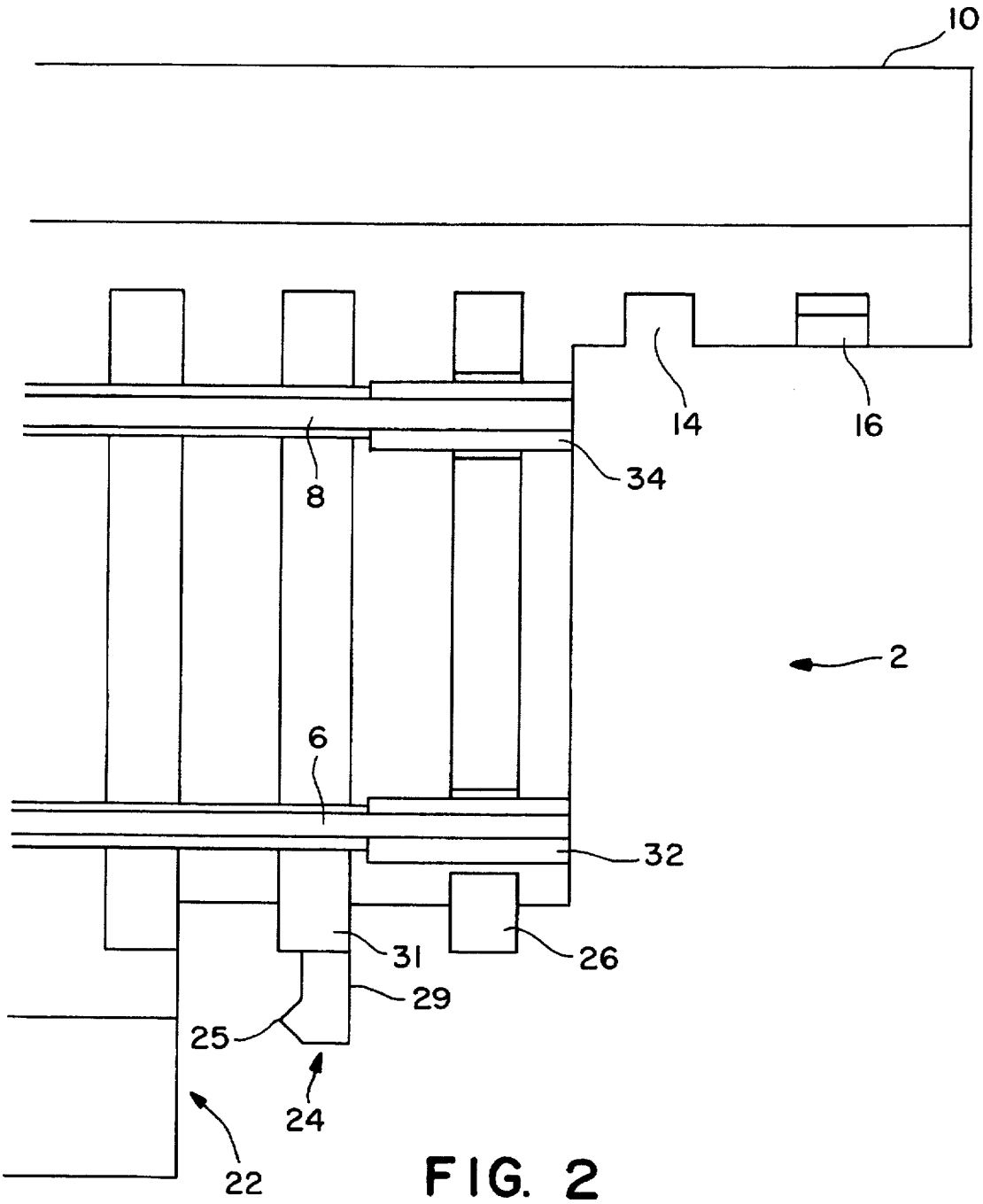
FIG. 2 of the drawing illustrates a top plan view of the end portion of one of the track sections to be joined together, as illustrated by FIG. 1.

FIG. 2 illustrates a top plan view of trackbed section 2, including rails 6 and 8 and electrical contacts 32 and 34 mounted to the rails 6 and 8. The electrical contacts 32 and 34 are provided for electrically coupling a power supply to the electrically conductive rails 6 and 8 for powering a model train travelling over the assembled tracks and rails. The same reference numerals have been used in FIG. 2 to designate elements corresponding to those disclosed in FIGS. 1 and 1A, as discussed herein.

Figure 3:
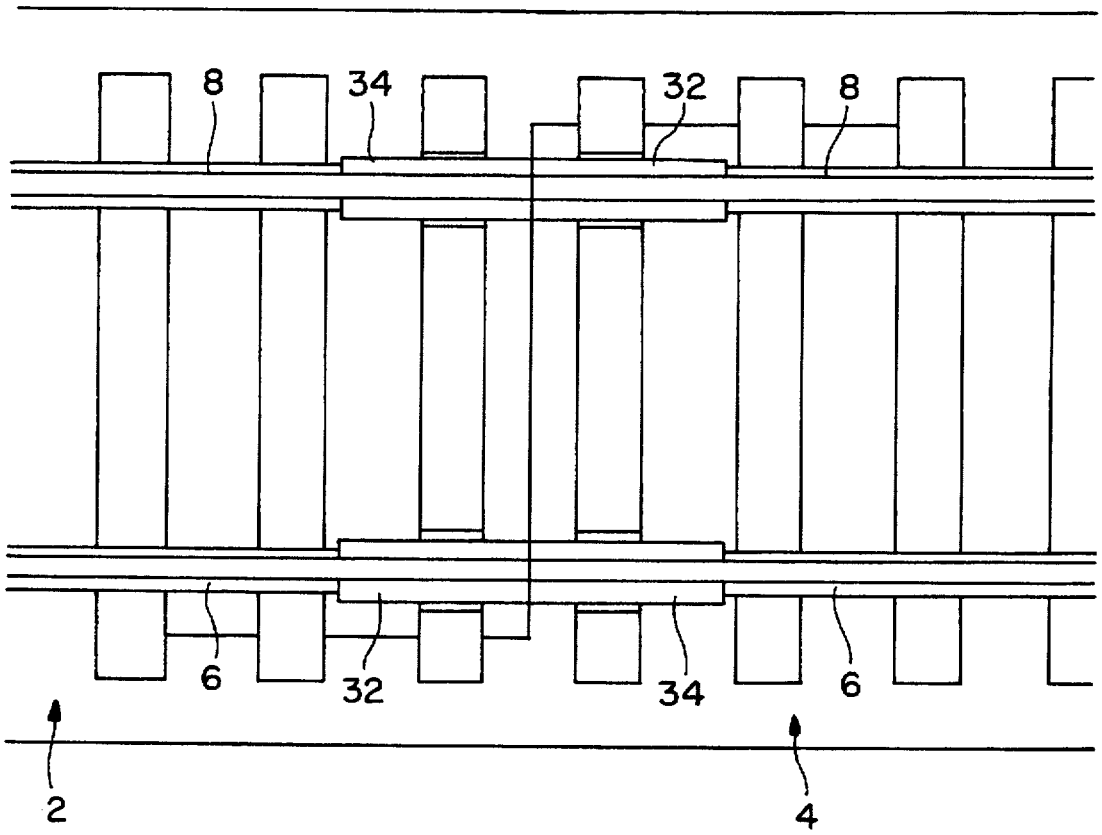
FIG. 3 illustrates a top plan view of the two track sections illustrated by FIG. 1, subsequent to assembly thereof.

FIG. 3 illustrates a top plan view showing trackbed sections 2 and 4, as illustrated in FIG. 1, after they have been removably locked together in accordance with the procedure described above. The orientation of the complementary projections and recesses defined on the adjacent ends of the joined track sections assure that when the sections are removably locked into the assembled position as illustrated by FIG. 3, the respective parallel rails 6 and 8 carried by each trackbed section are in linear alignment with each other, and are contiguously abutting against each other. Likewise, the respective electrical contacts 32 and 34 carried by the rails 6 and 8 on each trackbed section 2 and 4, are joined together in linear alignment and contiguously abutting engagement. The assembled track sections 2 and 4, when removably locked together, provide continuously aligned parallel rails 6 and 8, and provide a continuous electrically path for the flow of electrical energy through the assembled rails for driving a train thereon.

It becomes apparent from the present invention, that the rail joiners or connectors required in the assembly of track sections of known model track railroad systems, have been eliminated by the design of the present invention. Moreover, the removable locking means, e.g., the complementary recesses and projections defined on the extended and retracted portions of adjacent trackbed sections are oriented in a direction which is not linear with, and preferably transversely oriented relative to, the longitudinal direction of the trackbed sections and the rail sections carried thereon. Accordingly, as a result of the substantially perpendicular orientation between the direction of engagement of the locking means on adjacent trackbed sections and the direction and orientation of the parallel rails carried by the adjacent trackbed sections, movement of the train along the track (and other forces exerted in a linear direction relative to the track sections) will not disengage the transversely oriented locking means or result in separation of adjacent ends of joined trackbed sections. Therefore potential for derailment of a train travelling along the tracks, and disruption of continuous electrical current flow through the closed circuit defined by the assembled track sections, is significantly reduced as a result of the design of the present invention.

In accordance with the present invention, adjacent trackbed sections can be assembled more securely, more efficiently, and in less time than known track sections of conventional model railroads employing rail joiner or extender elements. Moreover, by providing releasably locking engagement at laterally offset positions on different sides of adjacent ends of joined trackbed sections (as discussed above), the overall integrity of the track locking engagement is enhanced. This latter result occurs because the position of locking engagement on each side of the adjacent joined trackbed sections is not along the same straight line (linear axis) oriented perpendicularly to the direction of the track and rail, but is offset from such linear axis. Accordingly, the adjacent removably locked trackbed sections cannot pivot along the transverse linear axis, thereby enhancing the integrity of the engagement of the adjacent trackbed sections when joined together. Thus, in accordance with the present invention, the substantially perpendicular orientation of engagement of the track locking means, together with the laterally offset locking positions defined on opposite sides of adjacent ends of joined track sections, result in enhanced integrity of the releasable locking engagement of adjacent trackbed sections.

Figure 4:
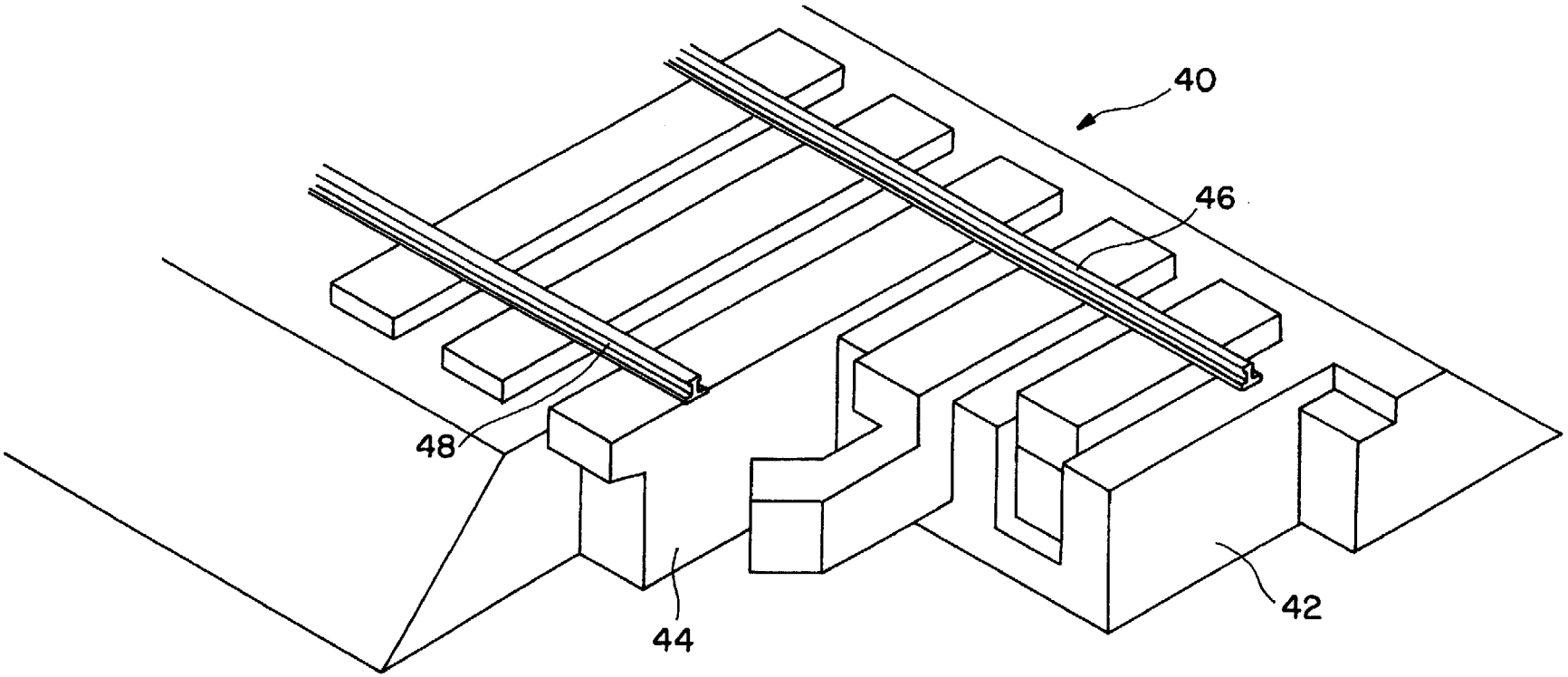
FIG. 4 illustrates a perspective view of the end portion of a track section in accordance with a second embodiment of the present invention.

FIG. 4 illustrates a second embodiment of a trackbed/rail design in accordance with the present invention. The trackbed section 40 shown in FIG. 4 includes an extended end portion 42 and a retracted end portion 44. A trackbed section carries parallel rails 46 and 48 for guiding a train and for conducting electrical energy for driving the train on a closed pattern formed from assembled trackbed sections. Adjacent trackbed sections 40 are removably locked to each other by complementary oriented and configured projections and recesses, similar to that described with respect to the first embodiment of the invention. The major difference between the track section 40 illustrated by FIG. 4, and track sections 2 and 4 illustrated by FIG. 1, is that the rail section 46 on extended position 42 of the trackbed 40 is extended relative to the rail section 48 on retracted portion 44 of the trackbed 40. Accordingly, trackbed section 40 provides offset parallel rail sections in addition to offset trackbed portions defined at the end of the trackbed section. At present, the embodiment of the invention illustrated by FIG. 4 is less preferable than that illustrated by FIG. 1–3 as a result of increased difficulty in the manufacture of arcuate track sections carrying offset arcuate parallel rails.

The above description of the drawings is intended to be illustrative, and not restrictive of the scope of the invention. Further modifications falling within the scope of the invention will become apparent to those skilled in the art. For example, as noted herein, the configuration and orientation of the locking means employed by the present invention may be varied from that disclosed herein. Accordingly, the scope of the present invention is not restricted to the specific embodiments of the invention discussed above, but is defined by the following claims and all equivalents thereto.

I claim:

1. In a track system for a model railroad train set of the type including a plurality of track sections removably connectable to each other to form a path of travel for a model train, the improvement comprising:

each of said plurality of track sections comprising a trackbed base section for carrying a pair of rails for guiding said model train; said trackbed base section having an extended portion defined on one side of each end thereof, and a recessed portion defined on another side of each of said ends thereof; said extended and recessed portions defined on each of said ends of said trackbed base adapted to mate with complementary portions defined on adjacent trackbed base sections for removably connecting a plurality of said trackbed base sections, wherein said extended and recessed portions on each of said plurality of trackbed base sections carry locking means thereon for removably connecting said plurality of said trackbed base sections together, wherein said locking means carried on said extended and recessed portions of said plurality of said trackbed base sections are oriented such that adjacent ends of said trackbed base sections are removably connected to each other at at least two separate locking positions, said at least two separate locking positions being laterally offset from each other and disposed towards opposite sides of said trackbed sections connected together such that said two separate locking positions are not oriented along the same linear axis extending in a perpendicular direction relative to the longitudinal direction of said trackbed base sections connected together.

2. The improvement as claimed in claim 1, wherein said plurality of said track base sections are removably connected together by movement of said adjacent trackbed base sections relative to each other at an angle relative to the longitudinal direction of at least one of said adjacent trackbed base sections, said relative movement of said adjacent trackbed base sections being along a plane substantially common to the plane along which said at least one of said trackbed base sections extends in said longitudinal direction.

3. The improvement as claimed in claim 1, wherein said trackbed base section is formed from a resilient material.

4. The improvement as claimed in claim 3, wherein said trackbed base section is formed from a plastic material.

5. The improvement as claimed in claim 1, wherein said locking means comprise at least one projection defined on one of said extended and recessed portions, and at least one recess defined on the other of said extended and recessed portions, said recess adapted to receive said projection for removably connecting said plurality of said trackbed base sections together.

6. The improvement as claimed in claim 5, wherein said at least one projection and said at least one recess are configured to cooperate with each other to removably retain said projection in friction fit engagement in said recess.

7. The improvement as claimed in claim 5, wherein said at least one projection is defined on said recessed portion of said trackbed base section, and said at least one recess is defined on said extended portion of said trackbed base section.

8. The improvement as claimed in claim 1, wherein said locking means carried on said extended and recessed portions of said plurality of trackbed base sections are oriented to removably engage in a direction at an angle relative to the longitudinal direction of said trackbed base sections joined together.

9. The improvement as claimed in claim 8 wherein said locking means carried on said .extended and recessed portions of said plurality of trackbed base sections are oriented to removably engage in a direction which is oriented substantially perpendicular to the longitudinal direction of said trackbed base sections joined together.

10. In a track system for guiding a toy travelling along a path defined by a plurality of interconnected track carrying sections, the improvement comprising:

each of said sections carrying locking means for removably connecting a plurality of said sections together, said locking means oriented such that cooperating locking means on adjacent sections connected to each other removably engage in a direction oriented at an angle relative to the longitudinal direction of at least one of said adjacent sections, wherein said locking means on said plurality of adjacent sections are oriented to removably engage at at least two different locking positions which are not oriented along the same linear axis perpendicular to the longitudinal direction of said at least one of said sections such that said at least two different locking positions are laterally offset relative to each other in the longitudinal direction of said at least one of said adjacent sections.

11. The improvement as claimed in claim 10 wherein said adjacent sections are removably engaged by relative movement of said adjacent sections along a plane substantially common to said longitudinal direction of extension of said at least one of said adjacent sections.

12. The improvement as claimed in claim 11, wherein said locking means on said adjacent sections are oriented to removably engage in a direction which is substantially perpendicular to said longitudinal direction of said at least one of said adjacent sections.

13. The improvement as claimed in claim 11, wherein each of said sections includes an extended portion and a recessed portion, said locking means being provided on said extended and recessed portions.

14. The improvement as claimed in claim 11 wherein said track system is for guiding a train of a model railroad set.

15. In a track system for guiding a toy travelling along a path defined by a plurality of interconnected sections, the improvement comprising:

each of said sections carrying locking means for removably connecting a plurality of sections together, said locking means on said sections being relatively oriented such that adjacent ends of adjacent sections are engaged at at least two separate locking positions, said two separate locking positions not oriented along a linear axis perpendicular to the longitudinal direction of at least one of said adjacent sections such that said at least two separate locking positions are offset relative to each other in the longitudinal direction of said at least one of said adjacent sections.

16. The improvement as claimed in claim 15, wherein one of said two separate locking positions is disposed towards a first side of said adjacent sections connected together, and the other of said two separate locking positions is disposed towards a second opposed side of said adjacent sections connected together.

17. The improvement as claimed in claim 15, wherein each of said sections comprises an extended portion and a recessed portion, said locking means on said adjacent sections being provided on said extended and recessed portions thereof.

18. The improvement as claimed in claim 15, wherein said locking means on one of said sections is arranged to engage said locking means on another of said sections in a direction that is oriented at an angle relative to the longitudinal direction of said at least one of said sections.

19. The improvement as claimed in claim 15, wherein said track system is for guiding a train of a model railroad set.

* * * * *